US010307624B2

(12) United States Patent
Strohman

(10) Patent No.: US 10,307,624 B2
(45) Date of Patent: Jun. 4, 2019

(54) ACTIVE TROLLEY SUPPORT SYSTEM

(71) Applicant: Gorbel, Inc., Fishers, NY (US)

(72) Inventor: Benjamin A. Strohman, Henrietta, NY (US)

(73) Assignee: Gorbel, Inc., Fishers, NY (US)

( * ) Notice: Subject to any disclaimer, the term of this patent is extended or adjusted under 35 U.S.C. 154(b) by 68 days.

(21) Appl. No.: 15/434,671

(22) Filed: Feb. 16, 2017

(65) Prior Publication Data

US 2017/0232279 A1 Aug. 17, 2017

Related U.S. Application Data

(60) Provisional application No. 62/296,057, filed on Feb. 16, 2016.

(51) Int. Cl.
*A62B 35/00* (2006.01)

(52) U.S. Cl.
CPC ..... *A62B 35/0087* (2013.01); *A62B 35/0093* (2013.01)

(58) Field of Classification Search
CPC combination set(s) only.
See application file for complete search history.

(56) References Cited

U.S. PATENT DOCUMENTS 3,760,910 A 8/1973 Koshihara
3,938,595 A * 2/1976 Swenson ..... E02D 7/08 173/1
6,065,710 A 5/2000 Richter et al.
6,928,336 B2 * 8/2005 Peshkin ..... G05B 19/41815 212/330
7,275,710 B2 * 10/2007 VanDruff ..... B64D 25/06 182/231
2001/0027149 A1 10/2001 Bingham
2008/0287268 A1 * 11/2008 Hidler ..... A61H 3/008 482/69
2011/0005861 A1 1/2011 Uhlig et al.
2014/0206503 A1 7/2014 Stockmaster et al.
2015/0143627 A1 5/2015 McBride
2015/0320632 A1 * 11/2015 Vallery ..... A61H 3/008 482/69

FOREIGN PATENT DOCUMENTS

EP 2609697 7/2013
EP 2404024 8/2013

OTHER PUBLICATIONS

PCT/US2017/18111 An International Search Report and Written Opinion dated May 26, 2017 May 26, 2017.

* cited by examiner

*Primary Examiner* — Alvin C Chin-Shue
(74) *Attorney, Agent, or Firm* — Duane C. Basch; Basch & Nickerson LLP

(57) ABSTRACT

A trolley for use with a fall arrest system, the trolley providing active control of both downward movement of a body attached to a rope or cable and horizontal position along a track.

19 Claims, 3 Drawing Sheets

ACTIVE TROLLEY SUPPORT SYSTEM

This application claims priority under 35 U.S.C. § 119 to U.S. Provisional Patent Application No. 62/296,057 for an ACTIVE TROLLEY, filed Feb. 16, 2016 by Benjamin A. Strohman and assigned to Gorbel, Inc., which is hereby incorporated by reference in its entirety.

Disclosed is a system and method for fall arrest and support with an active trolley. The system may include various configurations for a track system such as in a rehab center, but also may be suitable for use in a work or home environment where fall arrest protection is required for mobility.

BACKGROUND AND SUMMARY

Patient or body weight support systems are known. Examples such as Solo-Step overhead track support systems include not only a track but a trolley to which a rope and harness are attached to provide a fall-prevention system. Such systems, however, have fixed height settings and/or spring-loaded or shock-cords that not only require manual adjustment but lack basic safeguards that help to avoid placing users in difficult positions. For example, without a braking capability, in the event of a fall, a user would have to move the trolley to the track endpoint before there was any resistance to horizontal movement by the trolley.

Programmable body weight support systems such as the SafeGait™ system from Gorbel, Inc., are known for use in rehabilitation facilities and applications. As examples, the disclosures of U.S. Pat. No. 9,510,991 by J. Stockmaster et al., as well as co-pending U.S. patent application Ser. No. 15/361,975 for a MEDICAL REHAB LIFT SYSTEM AND METHOD WITH HORIZONTAL AND VERTICAL FORCE SENSING AND MOTION CONTROL, by J. Stockmaster at. Al (filed Nov. 28, 2016) and Ser. No. 15/187,089 for a BODY HARNESS, by B. Dolce et al. (filed Jun. 20, 2016), all assigned to Gorbel, Inc., and which are each hereby incorporated by reference in their entirety. While such systems may be employed in a person's work or home environment, it is often the case that slightly de-featured (e.g., without body weight support) and/or lower-cost systems could be better suited to provide moderate support or simply fall arrest for a person as necessary to facilitate mobility, where the trolley motion is controlled or limited, particularly in situations where a fall or other high-speed horizontal motion is detected.

In view of the requirement for a fall arrest trolley that has dynamic speed control and optional features that facilitate the mobility of users, the following embodiments for such a system and associated methods are disclosed.

Disclosed in embodiments herein is a fall arrest system, comprising: a rail (e.g., track); a trolley operatively associated with, and traveling along, said track; a trolley braking mechanism, associated with said trolley, said braking mechanism including a brake member that is placed into frictional contact with said track in response to a braking signal; a drum for winding/unwinding (lifting/lowering) a rope (or cable, strap, etc.) thereon; an energy storage assembly, operatively connected to the drum, for storing energy as the rope is unwound therefrom and releasing energy as the rope is rewound thereon; a drum rotation sensor, said rotation sensor sensing rotation of the drum and producing a drum rotation signal in response to such rotation; at least one rope angle sensor, said angle sensing when said rope exceeds a predefined angle relative to vertical (e.g., 30-degrees as measured beneath the trolley) and producing an excess angle signal in response thereto; and a controller receiving as inputs of at least the excess angle signal and/or the drum rotation signal and controlling the operation of fall arrest system, comprising: (a) initiating the trolley braking mechanism (e.g., screw motor) in response to at least the output of the rope angle sensor, and (b) stopping further drum rotation (e.g., clutch engagement) in response to at least the drum rotation signal.

Figure 1:
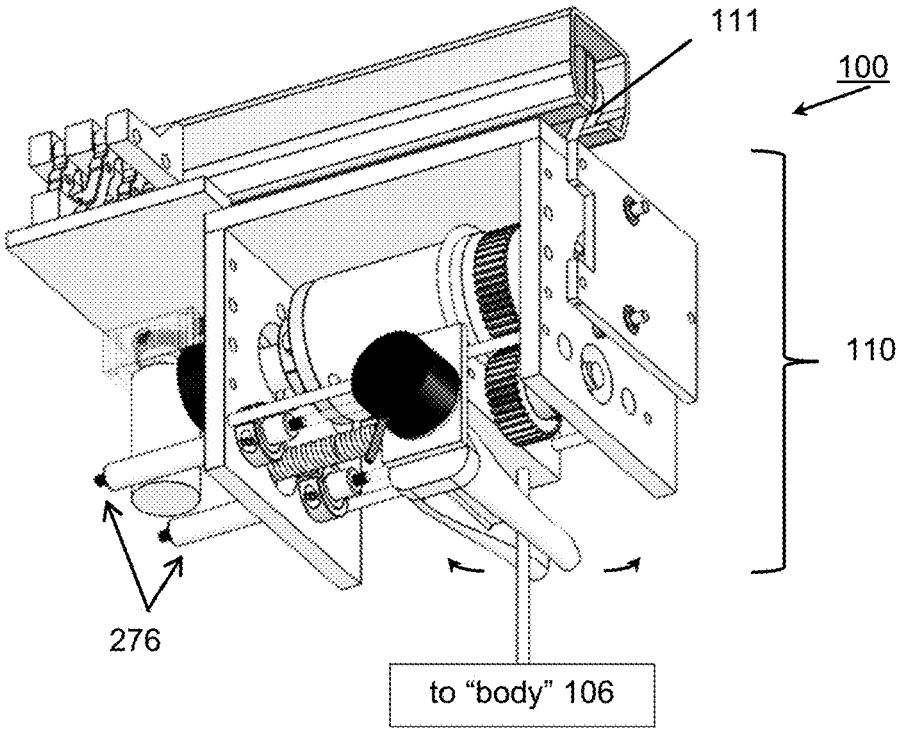
FIGS. 1 and 2 are, respectively, upward and downward perspective views of an embodiment of the fall arrest system as positioned on a piece of track.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Figure 2:
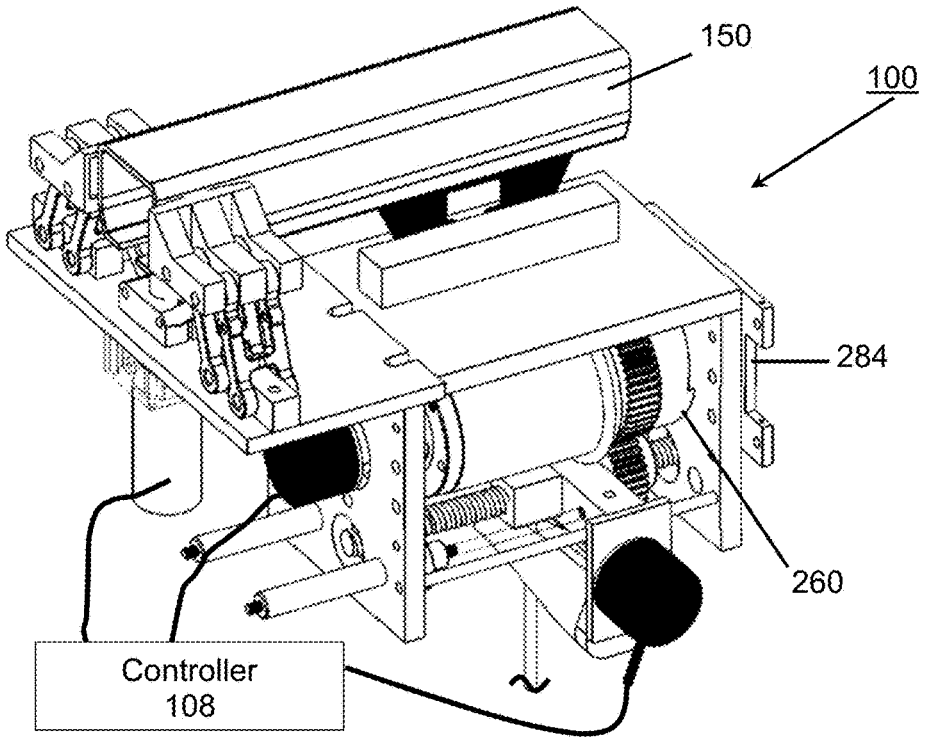
Figure 3:
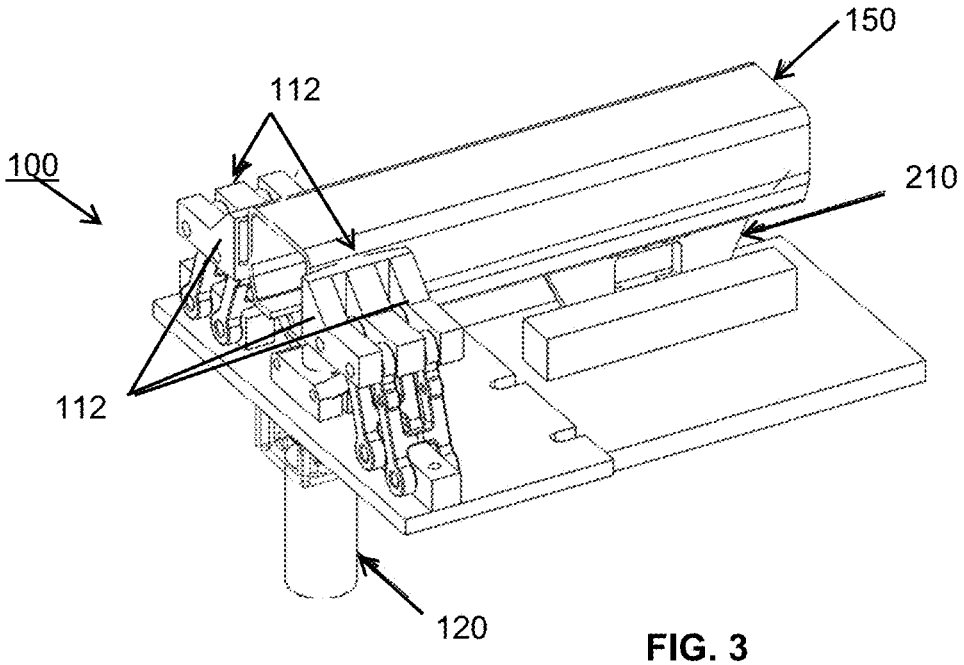
FIG. 3 is a partial view of the braking components of an embodiment of the system as illustrated in FIGS. 1-2.
Figure 4:
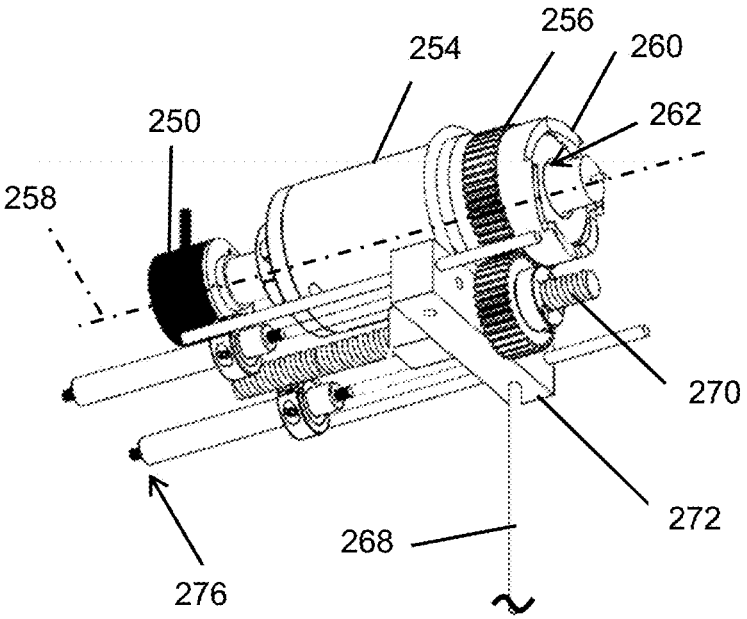
FIG. 4 is a perspective view of an energy storage assembly and the operatively connected drum in an embodiment of the system.

Referring to the figures, depicted in the perspective views of FIGS. 1 and 2 is a fall arrest system 100, suitable for arresting the falling motion of a user's body 106. As illustrated in FIGS. 3 and 4, system 100 includes a rail or track 150 and an operatively associated trolley 110 having a carriage with wheels 111 that roll along the track. The track may be a SafeGait rail (Gorbel, Inc.) or may be a simple I-beam or other cross-sectional shape. The trolley, which may include wheels or rollers matching the rail's profile (not shown), freely travels along and is suspended from or within the track. Although described relative to a track, it should be appreciated that the features of the disclosed fall arrest system may also be implemented on a similar overhead support such as a gantry, arm-lift, etc., and the range of horizontal motion is not necessarily limited to a pre-defined path. In other words, the path may be defined by a track or rail, a defined pattern or movement of a gantry or arm, or it may be free-flowing within a region covered by a gantry or arm.

Also referring to FIG. 3, illustrated is a trolley braking mechanism(s), associated with the trolley. The braking mechanism includes a brake member such as brake shoes 112, which may be arranged in opposing pairs, placed into frictional contact with the track 150, either on the inside or outside of the track, in response to a braking signal. In one embodiment, the braking signal may be interpreted by a controller 108 that, in turn, energizes a brake actuator 120, such as a gear motor that is operatively connected to the brake shoes to cause them to advance into contact with the track in response to the controller signal. As will be described in more detail below, operation of the braking assembly, as well as other features of the system may be facilitated by a controller or similar device 108.

In one embodiment, the controller 108 operates the brake actuator (gear motor) 120 in one of several modes, including at least: (a) free running (no brake); (b) locked (brake fully engaged); (c) drag (brake partially engaged to retard horizontal movement); and (d) dynamic drag (brake engaged proportional to external sensor to limit overshoot). As will be described, the controller may concurrently control the operation of other system features such as fall arrest and limits on rope height by setting virtual or selectable descent limit.

As will be appreciated, the disclosed system would further include a source of power such as battery power. Moreover, the battery power could be from a rechargeable battery that is charged at a docking station integrated into the rail assembly (not shown). Another feature that may be included is an input device (fob, pendant, handheld computing device and associated software application, or other devices), which may be wired or wireless, and that enables the manual control of one or more features of the system. The system controls may or may not require user input, and may also include: virtual limits to restrict or allow motion in zones; variable fall sensitivity (e.g., what sensor(s), or sensor signal level is used to trigger a response by the controller); variable braking force; and lights or other status indicators.

Turning to FIG. 4, depicted therein is a drum 254 that rotates about an axis 258 for winding and unwinding (lifting/lowering) the rope 268 including equivalent lifting medium such as cable, strap, etc. thereon. Associated with drum 254 is a drum rotation sensor such as a drum encoder 250, or similar mechanism used to sense the rotational or angular position of the drum. In operation, the drum rotation sensor senses rotation of the drum and produces a drum rotation signal in response to the rotation. The controller uses the rotation sensor signals as input to detect falls, virtual limit (e.g., lower travel limit), and potentially other telemetry. With the virtual limit, further motion (unwinding) may be prevented once the drum reaches the lower virtual limit position as detected from the encoder signal.

The drum is not driven except by the weight or force applied on the free (unwound) end of rope 268, however, the unwinding of the rope results in the storage of energy in the constant force (gas) springs 276 by way of drum gears 256 and clutch 260 that, in combination, serve to transmit the drum's rotational force to ball-screw 270, which back-drives the constant force springs 276 (e.g., pneumatic cylinders). Thus, a downward force on the rope results in an unwinding rotation of the drum and in turn the compression of springs 270. In this manner the rope provides a generally constant negligible upward force to the user's body (106) suspended in a harness therefrom. In addition, a secondary clutch mechanism 262 operates as a spring clutch bearing to allow upward travel of rope 268 only while primary clutch 260 is engaged. Thus, the springs 276 provide an energy storage assembly operatively connected to the drum; for storing energy as the rope is unwound therefrom and releasing energy as the rope is rewound thereon. In other words, in the fall arrest system 100 the energy storage assembly provides a generally fixed resistive force (e.g., rope tension) to the rope as it is raised and lowered.

Figure 5:
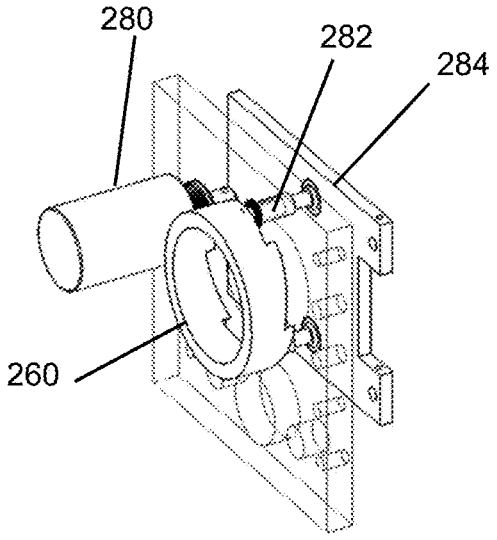
FIG. 5 is an assembly view of components that are operatively connected to the transmission and drum for use in stopping the unwinding of the drum/rope in the system.

As further illustrated in FIG. 5, the primary clutch 260 is controlled by actuator (solenoid) 280 (pins 282 are shown as engaged), working against a spring plate 284. As will be appreciated other means for controlling the engagement of the clutch 260 are possible, including a direct connection between the actuator solenoid and the pins of even a gravity-based clutch mechanism.

Figure 6:
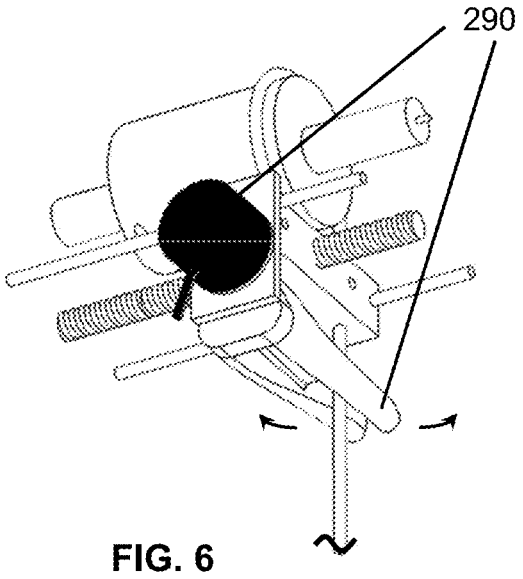
FIG. 6 is a partial view of the rope or lifting medium position sensor in accordance with one embodiment.

Depicted in FIG. 6 is at least one rope position or angle sensor 290. As the user moves the support system 100 travels along the rail 150, and because the unit is not powered it generally lags slightly behind due to inherent friction. When the user stops or changes direction the unit catches up and the swing of the sensor arm or similar medium towards a neutral position is detected and braking force can be applied to reduce overshoot. Also contemplated, although not shown could be a second, similar angle-sensing arrangement oriented perpendicular that could be used in conjunction with the first as part of the controls of a powered motion system, possibly an x-y bridge or gantry crane or a mobile platform. As will be appreciated, the rope angle sensor 290 detects when the rope exceeds a predefined angle relative to vertical (e.g., 30-degrees as measured beneath the support system trolley) and may produce an excess angle signal in response. The signal, fed to the controller, results in the application of a braking force to limit over-travel as well as other undesired movement of the trolley.

As suggested to above, controller 108 operates in response to the inputs of at least the excess rope angle signal and/or the drum rotation signal and controls the operation of the fall arrest system. Operations monitored and controlled by controller 108, which may be any programmable microprocessor or microcontroller, include (a) initiating the trolley braking mechanism (e.g., screw motor) in response to at least the output of the rope angle sensor, and (b) stopping further drum rotation (e.g., clutch engagement) in response to at least the drum rotation signal. In one embodiment, the rope is prevented from further downward motion (unwinding) in response to at least one of the following triggers: (i) reaching a predetermined travel limit, and/or (ii) detection of a fall as determined by the drum rotation signal exceeding a predefined unwinding rate. And, once triggered, unwinding rotation of the drum is prevented until a reset is performed.

As will be appreciated, the disclosed active trolley embodiment provides a fall protection-like feature, but with a selected, although adjustable, tension; similar to the manner in which self-retracting lanyards and the like operate. The selected tension is achieved by gas springs that are back-driven on a mechanical screw (e.g., ball screw) which may be considered analogous to an air balancer; brake is screw motor. Upon sensing conditions that indicate a fall, further motion of the drum and the trolley is disabled or prevented (locked-out) until there is a manual reset of the system. Moreover, the rope angle-sensing capability of the system prevents a user from being in a fall position and traversing a horizontal distance (as though trying to "catch" themselves) because they are unable to return to a more vertical position beneath the trolley. In other words, upon detection of the rope angle limit being reached due to a fall, the system applies drag (or stops) on horizontal movement of the trolley to allow the user to use the resistance of the trolley to assist with righting themselves.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. A fall arrest system, comprising:

a track;

a trolley operatively associated with, and traveling along, said track;

a trolley braking mechanism, associated with said trolley, said braking mechanism including a brake member that is placed into frictional contact with said track in response to a braking signal;

a drum for winding and unwinding a rope thereon;

an energy storage assembly, operatively connected to the drum, for storing energy as the rope is unwound therefrom and releasing energy as the rope is rewound thereon;

a drum rotation sensor, said rotation sensor sensing angular rotation of the drum about its axis and producing a drum rotation signal in response to such rotation;

at least one rope angle sensor, said angle sensor sensing when the rope exceeds a predefined angle relative to vertical and producing an excess angle signal in response thereto; and a controller receiving as inputs of at least the excess angle signal and the drum rotation signal and controlling the operation of the fall arrest system, including: (a) initiating the trolley braking mechanism, by outputting the braking signal in response to at least the excess angle signal, and (b) stopping further drum rotation in response to at least the drum rotation signal.

2. The fall arrest system according to claim 1, wherein the energy storage assembly includes a transmission for transforming stored potential energy into kinetic energy to retract the rope.

3. The fall arrest system according to claim 1, wherein the energy storage assembly provides a generally fixed resistive force to the rope as it is raised and lowered.

4. The fall arrest system according to claim 3 wherein said rope is prevented from further unwinding from said drum in response to at least one of the following triggers: (a) reaching a predetermined travel limit, and (b) detection of a fall as determined by the drum rotation signal exceeding a predefined unwinding rate.

5. The fall arrest system according to claim 4 wherein unwinding rotation of the drum is prevented subsequent to one of said triggers until a reset is performed.

6. The fall arrest system according to claim 1, wherein braking modes for said trolley braking mechanism include: (a) free running; (b) locked; (c) drag; and (d) dynamic drag.

7. The fall arrest system according to claim 1, wherein said trolley is connected to a carriage having wheels that roll on an interior surface of said track to permit said carriage to travel therealong.

8. The fall arrest system according to claim 1, wherein the brake member includes at least one brake shoe pair operatively connected to a brake actuator, wherein the at least one brake shoe pair is placed into frictional contact with said track in response to the braking signal.

9. The fall arrest system according to claim 1, wherein said rope angle sensor outputs the excess angle signal in response to the rope angle exceeding thirty degrees, as measured relative to vertical beneath the trolley.

10. The fall arrest system according to claim 1, wherein said energy storage assembly for storing energy includes at least one constant force spring.

11. A fall arrest system, comprising:

a track;

a trolley operatively associated with, and traveling along, said track;

a trolley braking mechanism, associated with said trolley, said braking mechanism including a brake member that is placed into frictional contact with said track in response to a braking signal;

a drum for winding and unwinding a rope thereon;

an energy storage assembly, operatively connected to the drum, for storing energy as the rope is unwound therefrom and releasing energy as the rope is rewound thereon, wherein said energy storage assembly for storing energy includes at least one constant force spring and where the at least one constant force spring includes a gas spring;

a drum rotation sensor, said rotation sensor sensing angular rotation of the drum about its axis and producing a drum rotation signal in response to such rotation;

at least one rope angle sensor, said angle sensor sensing when the rope exceeds a predefined angle relative to vertical and producing an excess angle signal in response thereto; and a controller receiving as inputs of at least the excess angle signal and the drum rotation signal and controlling the operation of the fall arrest system, including: (a) initiating the trolley braking mechanism in response to at least an output of the rope angle sensor, and (b) stopping further drum rotation in response to at least the drum rotation signal.

12. The fall arrest system according to claim 11, wherein energy storage assembly includes a transmission for transforming stored potential energy into kinetic energy to retract the rope.

13. The fall arrest system according to claim 11, wherein the energy storage assembly provides a generally fixed resistive force to the rope as it is raised and lowered.

14. The fall arrest system according to claim 13 wherein said rope is prevented from further unwinding from said drum in response to at least one of the following triggers: (a) reaching a predetermined travel limit, and (b) detection of a fall as determined by the drum rotation signal exceeding a predefined unwinding rate.

15. The fall arrest system according to claim 14 wherein unwinding rotation of the drum is prevented subsequent to one of said triggers until a reset is performed.

16. The fall arrest system according to claim 11, wherein braking modes for said trolley braking mechanism include: (a) free running; (b) locked; (c) drag; and (d) dynamic drag.

17. The fall arrest system according to claim 11, wherein said trolley is connected to a carriage having wheels that roll on an interior surface of said track to permit said carriage to travel therealong.

18. The fall arrest system according to claim 11, wherein the brake member includes at least one brake shoe pair operatively connected to a brake actuator, wherein the at least one brake shoe pair is placed into frictional contact with said track in response to the braking signal.

19. The fall arrest system according to claim 11, wherein said rope angle sensor outputs the excess angle signal in response to the rope angle exceeding thirty degrees, as measured relative to vertical beneath the trolley.

* * * * *